US007202880B2

(12) United States Patent
Takahashi

(10) Patent No.: US 7,202,880 B2
(45) Date of Patent: Apr. 10, 2007

(54) IMAGE DISPLAY DEVICE

(75) Inventor: Hiroyuki Takahashi, Funabashi (JP)

(73) Assignee: Hitachi Displays, Ltd., Mobara-Shi (JP)

( * ) Notice: Subject to any disclaimer, the term of this patent is extended or adjusted under 35 U.S.C. 154(b) by 576 days.

(21) Appl. No.: 10/790,813

(22) Filed: Mar. 3, 2004

(65) Prior Publication Data

US 2004/0239667 A1 Dec. 2, 2004

(30) Foreign Application Priority Data

Mar. 3, 2003 (JP) ..... 2003-055910

(51) Int. Cl.
*G09G 5/10* (2006.01)

(52) U.S. Cl. ..... 345/690; 345/89

(58) Field of Classification Search ..... 345/690, 345/209, 89, 90, 92, 95, 96, 100
See application file for complete search history.

(56) References Cited

U.S. PATENT DOCUMENTS

2002/0180673 A1* 12/2002 Tsuda et al. ..... 345/87
2002/0186192 A1* 12/2002 Maruoka et al. ..... 345/87
2003/0107698 A1* 6/2003 Nagayama et al. ..... 349/149

* cited by examiner

*Primary Examiner*—Richard Hjerpe
*Assistant Examiner*—Jean Lesperance
(74) *Attorney, Agent, or Firm*—Antonelli, Terry, Stout & Kraus, LLP.

(57) ABSTRACT

An image display device is capable of preventing the occurrence of flickers on a display screen by automatically adjusting a common voltage applied to common electrodes without providing light receiving elements. A plurality of dummy pixels which are arranged in the periphery of an image display part include pixel electrodes. A potential difference is detected between a voltage of the pixel electrodes of the dummy pixels to which a gray scale voltage of positive polarity is written and a common voltage applied to the common electrodes, a potential difference is detected between a voltage of the pixel electrodes of the dummy pixels to which a gray scale voltage of negative polarity is written and the common voltage, and the common electrodes are controlled so as to make the first potential difference and the second potential difference equal to each other.

13 Claims, 10 Drawing Sheets

IMAGE DISPLAY DEVICE

BACKGROUND OF THE INVENTION

The present invention relates to an image display device of the type which is mounted on portable equipment (for example, a mobile phone) or the like, and, more particularly, the invention relates to a technique which is effective at the time of automatically adjusting a common voltage applied to common electrodes in such an image display device.

A TFT (Thin Film Transistor) type liquid crystal display module having a miniaturized liquid crystal display panel, which is capable of producing a color display having a pixel arrangement of 100×150×3 pixels, is popularly used as a display part of portable equipment, such as a mobile phone.

FIG. 10 is a block diagram showing the circuit constitution of a conventional TFT type liquid crystal display module. As shown in the drawing, the conventional liquid crystal display module is constituted of a liquid crystal display panel 100, a display control device 110, a power source circuit 120, a drain driver 130 and a gate driver 140.

FIG. 11 is an equivalent circuit diagram of one example of the liquid crystal display panel 100 shown in FIG. 10. As shown in FIG. 11, the liquid crystal display panel 100 includes a plurality of pixels arranged in a matrix array. Each pixel is arranged a region bounded by two neighboring signal lines (drain signal lines D or gate signal lines G) and two neighboring signal lines (gate signal lines G or drain signal lines D). Each pixel includes a thin film transistor (TFT), and a source electrode of the thin film transistor (TFT) of each pixel is connected to a pixel electrode (ITO1).

Further, since a liquid crystal layer is provided between the pixel electrode (ITO1) and a common electrode (also referred to as a counter electrode) (ITO2), a liquid crystal capacitance ($C_{LC}$) is equivalently connected between the pixel electrode (ITO1) and the common electrode (ITO2). Still further, between the source electrode of the thin film transistor (TFT) and the common electrode (ITO2), a storage capacitance ($C_S$) is connected.

In the liquid crystal display panel 100 shown in FIG. 10, the drain electrodes of the thin film transistors (TFT) of respective pixels, which are arranged in the column direction, are respectively connected to the drain signal lines (also referred to as video signal lines) D, and the respective drain signal lines D are connected to the drain driver 130, which applies gray scale voltages to the liquid crystal of respective pixels in the column direction.

Further, the gate electrodes of the thin film transistors (TFT) of respective pixels, which are arranged in the row direction, are respectively connected to the gate signal lines (also referred to as scanning signal lines) G, and the respective gate signal lines G are connected to the gate driver 140, which applies a scanning driving voltage (a positive bias voltage or a negative bias voltage) to the gate electrodes of the thin film transistors (TFT) of respective pixels in the row direction for one horizontal scanning period.

The display control device 110 controls and drives the drain driver 130 and the gate driver 140 in response to respective display control signals, including clock signals, display timing signals, horizontal synchronizing signals and vertical synchronizing signals, and display data (R, G, B) which are transmitted from the outside.

The power source circuit 120 supplies a gray scale reference voltage to the drain driver 130 and, at the same time, supplies a scanning driving voltage to the gate driver 140 and, further, supplies a common voltage to the common electrodes (ITO2). Further, the power source circuit 120 supplies a power source voltage for the drain driver 130 and the gate driver 140 to the drain driver 130 and the gate driver 140.

The gate driver 140 sequentially supplies a scanning signal voltage, which turns on the thin film transistor (TFT), to the gate signal lines G one after another for every one horizontal scanning period, thus turning on the thin film transistors (TFT).

Further, the drain driver 130 supplies a video signal voltage to the drain signal lines D and applies the video signal voltage to the pixel electrodes (ITO1) through the thin film transistors (TFT) which are turned on, writes the video signal voltage into the respective pixels, and charges a given voltage to the liquid crystal capacitances ($C_{LC}$) between the pixel electrodes (ITO1) and the common electrodes (ITO2).

The orientation directions of liquid crystal molecules of respective pixels are changed based on the charged voltage so as to display an image. In accordance with the above-mentioned operations, an image is displayed on the liquid crystal display panel 100.

Here, when a DC voltage is applied to the liquid crystal, the lifetime of the liquid crystal becomes short. To prevent such a phenomenon, in the liquid crystal display module, the voltage applied to the liquid crystal layer is alternated every fixed period. That is, the voltage applied to the pixel electrodes is changed to the positive voltage side (hereinafter referred to as a gray scale voltage of positive polarity) and the negative voltage side (hereinafter referred to as a gray scale voltage of negative polarity) with respect to the voltage applied to the common electrodes, which are used as the reference for every fixed period.

In the above-mentioned constitution, it is ideal that the voltage applied to the liquid crystal at the time of writing is held until the next writing takes place. However, in an actual operation, as indicated by the dotted line in FIG. 11, there exists a floating capacitance ($C_{GS}$) between the source and gate of the thin film transistor (TFT); and, hence, after the thin film transistor (TFT) is turned off, the voltage of the pixel electrodes is changed due to the floating capacitance ($C_{GS}$). A voltage change quantity ΔV attributed to the floating capacitance ($C_{GS}$) is expressed by a following formula (1).

$$\Delta V = C_{GS}/(C_{LC}+C_{GS}) \times \Delta V_G \quad (1)$$

Here, $\Delta V_G$ indicates the difference between the gate voltage when the thin film transistor (TFT) is in an ON state and the gate voltage when the thin film transistor (TFT) is in an OFF state.

In this manner, the voltage (that is, the voltage of the pixel electrodes (ITO1) which is actually held in the liquid crystal) is changed from the liquid crystal applied voltage which is applied to the drain signal lines (D) by ΔV.

Here, although the voltage of the pixel electrodes (ITO1) is also changed due to the influence of other floating capacitances, an explanation is made with respect to only the floating capacitance $C_{GS}$ between the gate and the source of the thin film transistor (TFT), since it exerts the largest influence on the voltage of the pixel electrodes (ITO1).

Further, although the voltage (Vcom) which is applied to the common electrodes (ITO2) is originally to be set to a center value of the liquid crystal applied voltage, since the voltage of the pixel electrode (ITO1) is changed in response to the liquid crystal applied voltage by ΔV, the potential difference between the voltage of the pixel electrode (ITO1) at the time of positive polarity and the voltage (Vcom) of the common electrodes and the potential difference between the voltage of the pixel electrode (ITO1) at the time of negative polarity and the voltage (Vcom) of the common electrodes differ from each other; and, hence, an asymmetrical voltage is applied to the liquid crystal with respect to the voltage (Vcom) of the common voltage (ITO2) between the case of positive polarity and the case of negative polarity.

When such an asymmetrical voltage is applied to the liquid crystal, flickers are generated on the screen. For example, in producing a display using a signal source having the vertical synchronizing signal of 60 Hz, when a voltage of the same polarity is applied to all neighboring pixels and the polarity of the voltage is inverted for every one screen, the polarity of the voltage is changed at a cycle of 30 Hz. That is, the asymmetrical voltage is held in the liquid crystal at a cycle of 30 Hz and the brightness is changed by an amount corresponding to the voltage difference; and, this change of brightness is observed as flickers.

Accordingly, it is necessary to adjust the voltage (Vcom) applied to the common electrodes (ITO2) in response to the above-mentioned voltage change quantity ΔV. However, the required adjustment quantity differs delicately for respective products (LCD), and, hence, it is necessary to perform a specified adjustment for respective liquid crystal panels.

In general, as methods for adjusting the voltage (Vcom) applied to the common electrodes (ITO2), there have been known a method in which an operator manually performs the adjustment by confirming an actual state of flickers on a liquid crystal panel and a method which automatically performs the adjustment.

In the manual adjusting method, the voltage (Vcom) applied to the common electrodes (ITO2) is generally adjusted by changing the resistance value of a variable resistance. In this case, a method which facilitates the adjusting method is described in Japanese Unexamined Patent Publication Hei8(1996)-63128 (patent literature 1).

Further, with respect to the automatic adjusting method, Japanese Unexamined Patent Publication Hei10(1998)-246879 (patent literature 2) and Japanese Unexamined Patent Publication Hei8(1996)-286169 (patent literature 3) describe a method in which dummy pixels are provided, a specific gray scale voltage is applied to the dummy pixels, light emitted from the dummy pixels is converted into a voltage by light receiving elements, and a voltage (Vcom) applied to common electrodes (ITO2) is adjusted based on the voltage.

SUMMARY OF THE INVENTION

However, with respect to the method in which the operator manually adjusts the voltage (Vcom) applied to the common electrodes (ITO2), it is necessary for the operator to perform the adjustment on every liquid crystal panel at the time of shipping the products; and, hence, even when the method which facilitates the adjustment method is used as described in the patent literature 1, the adjustment operation is difficult, whereby there has been a drawback that the operation efficiency is lowered.

Further, with respect to the method which automatically performs the adjustment, as described in the patent literatures 2, 3, it is necessary to convert the emitted light from the dummy pixels into a voltage using light receiving elements, and, hence, there has been a drawback that light receiving elements are required.

The present invention has been made to solve the above-mentioned drawbacks, and it is an object of the present invention to provide an image display device which is capable of preventing the occurrence of flickers on a display screen by automatically adjusting a common voltage applied to common electrodes without necessitating the use of light receiving elements.

The above-mentioned and other objects and novel features of the present invention will become more apparent from the description in this specification and the attached drawings.

A summary of representative aspects of the invention disclosed in this specification is as follows.

In an image display device according to the present invention, a plurality of dummy pixels having pixel electrodes are provided at the periphery of an image display part for displaying an image, a potential difference between the voltage of the pixel electrodes of the dummy pixels in which a gray scale voltage of positive polarity is written, among the plurality of dummy pixels, and a common voltage applied to common electrodes, and a potential difference between the voltage of the pixel electrodes of the dummy pixels in which a gray scale voltage of negative polarity is written, among the plurality of dummy pixels, and the common voltage applied to the common electrodes are detected, and the common voltage applied to the common electrodes is controlled so as to make these two potential differences equal to each other.

According to another aspect of the present invention, in an image display device according to the present invention, which includes an image display part for displaying an image and a plurality of dummy pixels which are arranged at the periphery of the image display part, the plurality of dummy pixels are pixels to which a voltage is applied based on pixel electrodes and common electrodes corresponding to the dummy pixels, a first potential difference between the voltage of the pixel electrodes of the dummy pixels to which a given gray scale voltage of positive polarity is written, among the plurality of dummy pixels, and a common voltage applied to the common electrodes corresponding to the dummy pixels is detected, a second potential difference between the voltage of the pixel electrodes of the dummy pixels to which a given gray scale voltage of negative polarity is written, among the plurality of dummy pixels, and the common voltage applied to the common electrodes corresponding to the dummy pixels is detected, and the voltage applied to the common electrodes is controlled so as to make the first potential difference and the second potential difference equal to each other.

DETAILED DESCRIPTION OF THE INVENTION

Preferred embodiments of an image display device according to the present invention will be explained in detail in conjunction with the drawings hereinafter.

In all of the drawings, parts having identical functions are identified by the same symbols, and a repeated explanation thereof will be omitted.

[Constitution of an Image Display Module which Constitutes a Premise of the Present Invention (the Explanation Being Directed to a Liquid Crystal Display Module)]

Figure 1A:
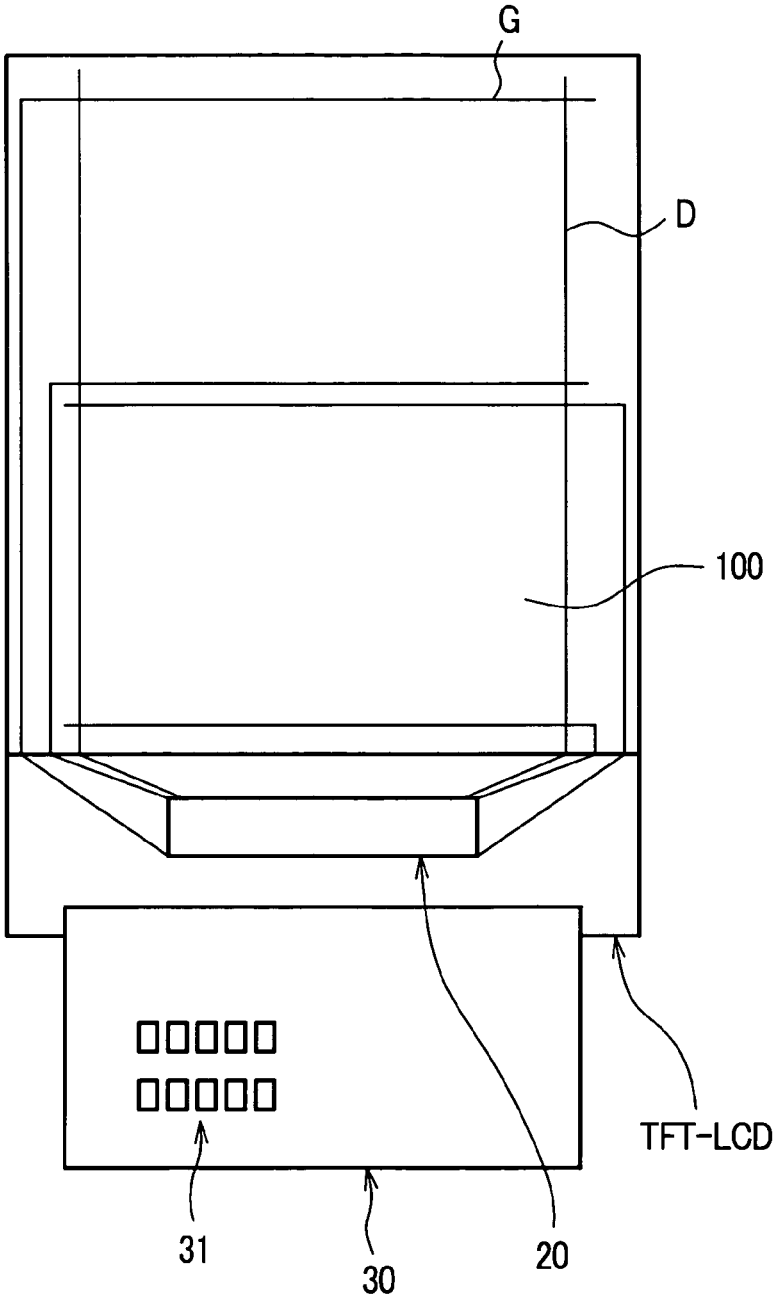
FIG. 1A is a diagrammatic plan view and FIG. 1B is a diagrammatic side view showing the constitution of one example of an image display module (a liquid crystal display module) which constitutes a premise of the present invention.
Figure 1B:
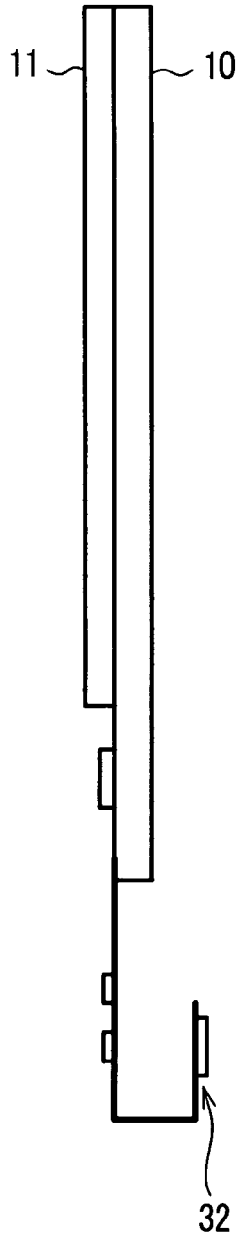

FIG. 1A is a plan view and FIG. 1B is a side view showing the constitution of the liquid crystal display module which constitutes the premise of the present invention.

Here, the TFT type liquid crystal display module shown in FIG. 1A is used as a display part of a mobile phone, for example.

In the liquid crystal display module (TFT-LCD) shown in FIG. 1A, a liquid crystal display panel 100 is configured such that one substrate (also referred to as a TFT substrate) 10 and another substrate (also referred to as a filter substrate) 11 are overlapped relative to each other with a given gap being disposed therebetween, and they are laminated to each other by a sealing material which is provided in a frame shape in the vicinity of a peripheral portion between both substrates. Liquid crystal is filled into and sealed in a space defined between both substrates and the inside of the sealing material, and, further, polarizers are laminated to the outsides of both substrates.

Here, the substrate 10 is formed of glass, for example, and pixel electrodes (ITO1), thin film transistors (TFT) and the like are formed on the substrate 10. On the other hand, the substrate 11 is formed of glass, for example, and common electrodes (ITO2), color filters and the like are formed on the substrate 11.

Figure 10:
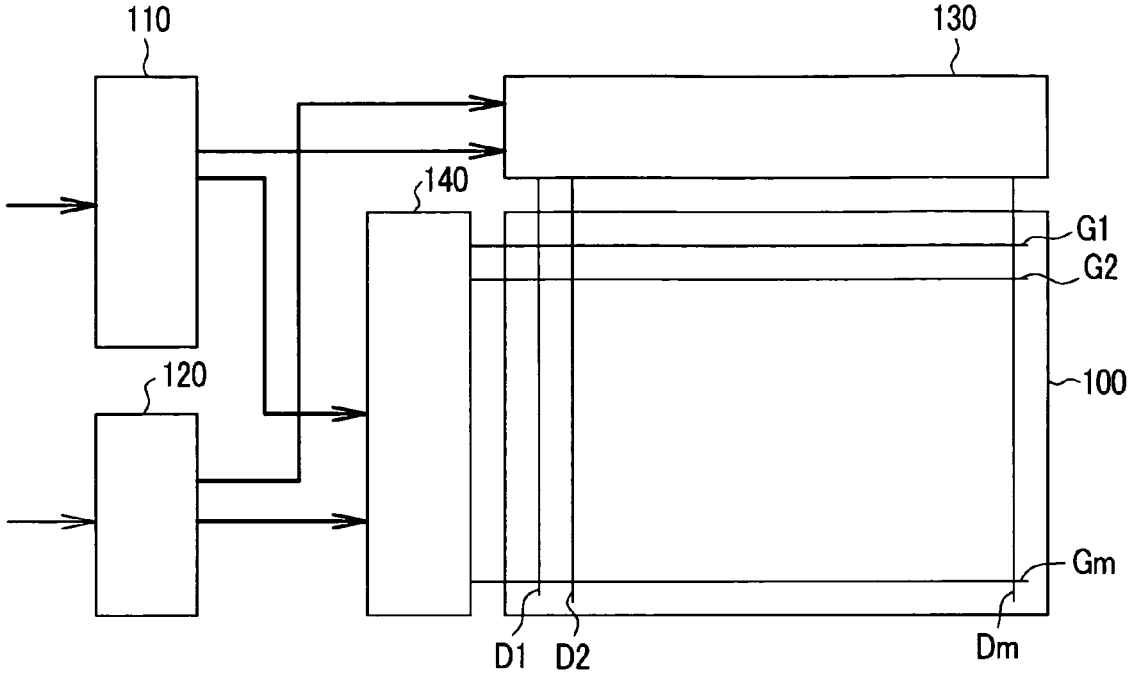
FIG. 10 is a block diagram showing the circuit constitution of a conventional TFT type liquid crystal display module.

A liquid crystal driver 20 is mounted on one substrate 10, and this liquid crystal driver 20 is constituted by integrating respective functions of the display control device 110, the power source circuit 120, the drain driver 130 and the gate drivers 140, shown in FIG. 10, into the inside of one chip. Here, in FIG. 1A, symbol D indicates drain signal lines and symbol G indicates gate signal lines.

Further, on an end portion of substrate 10, a flexible printed wiring board 30 is mounted. On the flexible printed wiring board 30, chip elements 31, such as resistance elements, capacitance elements and the like, are mounted. Still further, an end portion of the flexible printed wiring board 30 is bent, and a connector 32, which is connected to a body portion of a mobile phone, is provided to the bent portion.

Figure 11:
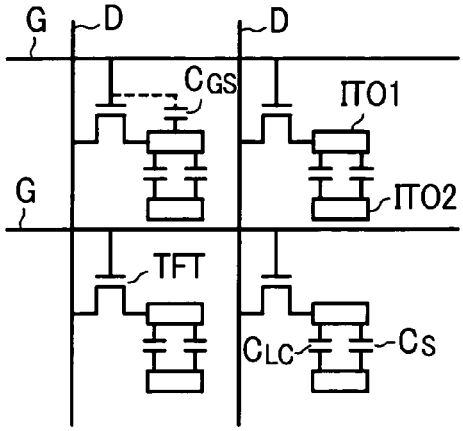
FIG. 11 is a an equivalent circuit diagram of one example of a portion of the image display panel (the liquid crystal display module) shown in FIG. 10.

Here, the circuit constitution of the liquid crystal display module shown in FIG. 1A and an equivalent circuit of the liquid crystal display module 100 are equal to those shown in FIG. 10 and FIG. 11, and, hence, a repeated explanation thereof will be omitted.

As mentioned previously, when the same voltage (DC voltage) is applied to a liquid crystal layer for a long time, the inclination of the liquid crystal layer becomes fixed, and, hence, an image retention phenomenon is induced as a result, whereby the lifetime of the liquid crystal layer is shortened.

To prevent the occurrence of such a phenomenon, in the liquid crystal display module, the voltage applied to the liquid crystal layer is alternated every fixed time, that is, using a voltage applied to common electrodes as the reference, the voltage applied to the pixel electrodes is changed to a positive polarity side and a negative polarity side for every fixed time.

As a driving method which applies an AC voltage to the liquid crystal layer, two methods, that is, a common electrode symmetry method and a common electrode inversion method, are known.

The common electrode inversion method is a method which alternately inverts the voltage applied to the common electrodes and the voltage applied to the pixel electrodes to a positive polarity and a negative polarity.

On the other hand, the common electrode symmetry method is a method in which the voltage applied to the common electrodes is set as a fixed value and the voltage applied to the pixel electrodes is alternately inverted to a positive polarity and a negative polarity while using the voltage applied to the common electrodes as a reference.

In the liquid crystal display module shown in FIG. 1A, as the AC driving method, the common electrode inversion method is used. Hereinafter, the common electrode inversion method will be explained.

Figure 2:
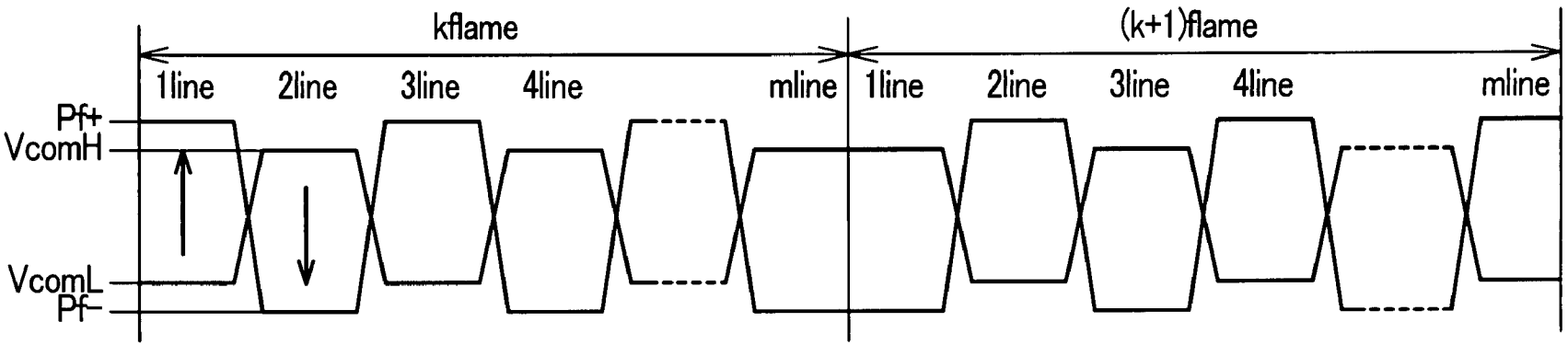
FIG. 2 is a timing diagram illustrating a common electrode inverting scheme in an AC driving method of the image display module (the liquid crystal display module)

FIG. 2 is a timing diagram which illustrates the common electrode inversion method. Here, the explanation is directed to a case in which the polarities are inverted for every one horizontal scanning line (hereinafter simply referred to as every line).

As shown in FIG. 2, in an odd-numbered line (for example, lines 1, 3, 5 or the like) in a k-frame, a gray scale voltage of positive polarity is applied to pixel electrodes (ITO1) of the respective pixels (that is, the respective drain signal lines D), and, at the same time, a common voltage (VcomL) of negative polarity is applied to the common electrodes (ITO2). Further, in an even-numbered line (for example, lines 2, 4, 6 or the like) in the k-frame, a gray scale voltage of negative polarity is applied to pixel electrodes (ITO1) of the respective pixels and, at the same time, a common voltage (VcomH) of positive polarity is applied to the common electrodes (ITO2).

Then, in an odd-numbered line (for example, line 1, 3, 5 or the like) in a (k+1)-frame which succeeds the k-frame, a gray scale voltage of negative polarity is applied to pixel electrodes (ITO1) of the respective pixels, and, at the same time, a common voltage (VcomH) of positive polarity is applied to the common electrodes (ITO2). Further, in an even-numbered line (for example, lines 2, 4, 6 or the like) in the (k+1)-frame, a gray scale voltage of positive polarity is applied to pixel electrodes (ITO1) of the respective pixels, and, at the same time, a common voltage (VcomL) of negative polarity is applied to the common electrodes (ITO2).

Here, in FIG. 2, arrows indicate the polarities applied to the liquid crystal.

[Embodiment]

Figure 3:
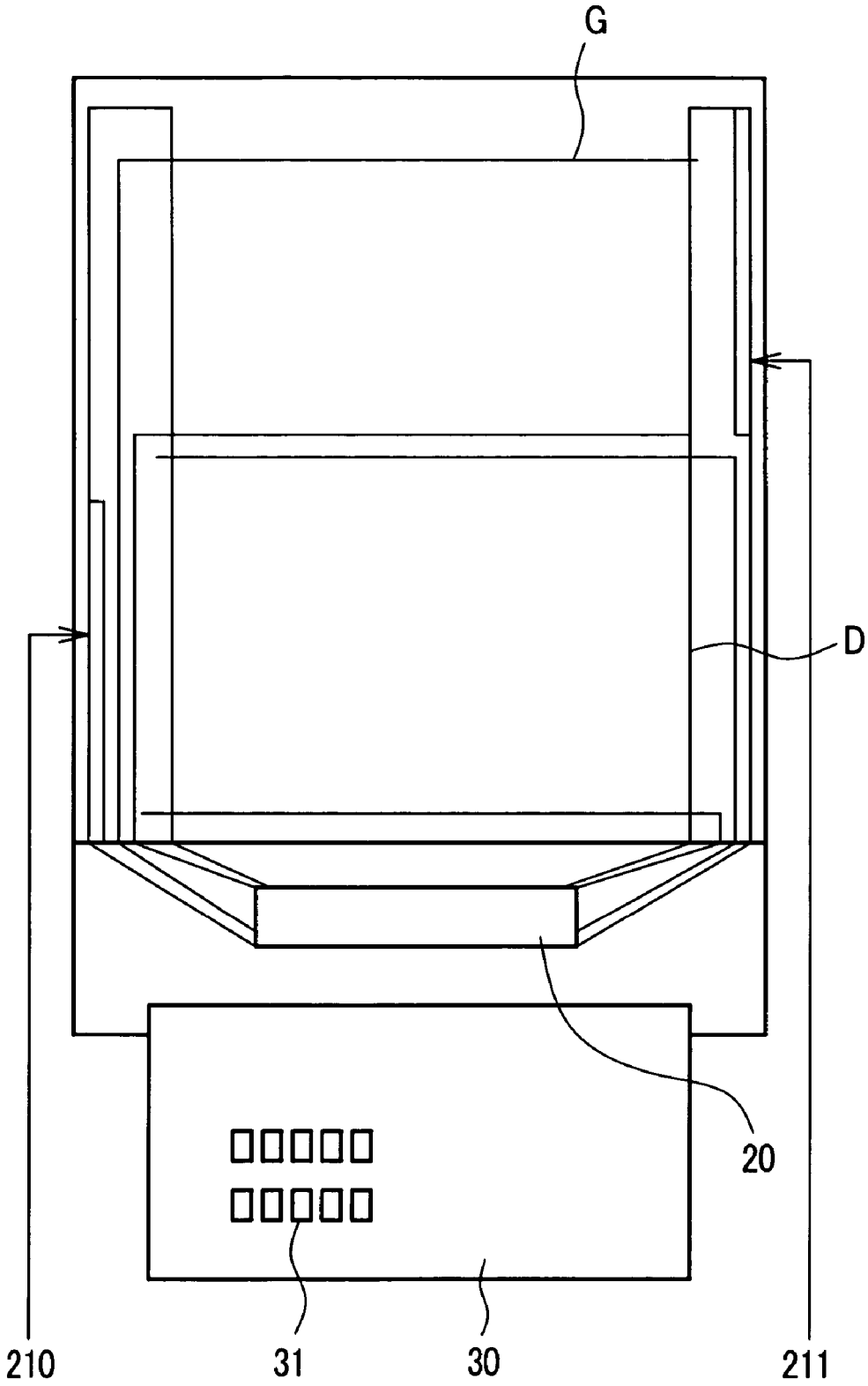
FIG. 3 is a diagrammatic plan view showing the constitution of an image display module (a liquid crystal display module) of one embodiment of the present invention.

FIG. 3 is a diagram showing the constitution of the liquid crystal display module of one embodiment of the present invention.

As shown in the drawing, in the liquid crystal display module of this embodiment, dummy pixels (210, 211) are arranged at the outside of an effective display region of the liquid crystal display panel 100. Each dummy pixel (210, 211) includes a thin film transistor (TFT), and a source electrode of the thin film transistor (TFT) of each dummy pixel (210, 211) is connected to the pixel electrode (ITO1).

Further, since the liquid crystal layer is formed between the pixel electrodes (ITO1) and the common electrodes (ITO2), a liquid crystal capacitance ($C_{LC}$) (not shown in the drawing) is equivalently connected between the pixel electrode (ITO1) and the common electrode (ITO2). Further, between the source electrode of the thin film transistor (TFT) and the common electrode (ITO2), a storage capacitance ($C_S$) (not shown in the drawing) is connected.

Figure 4:
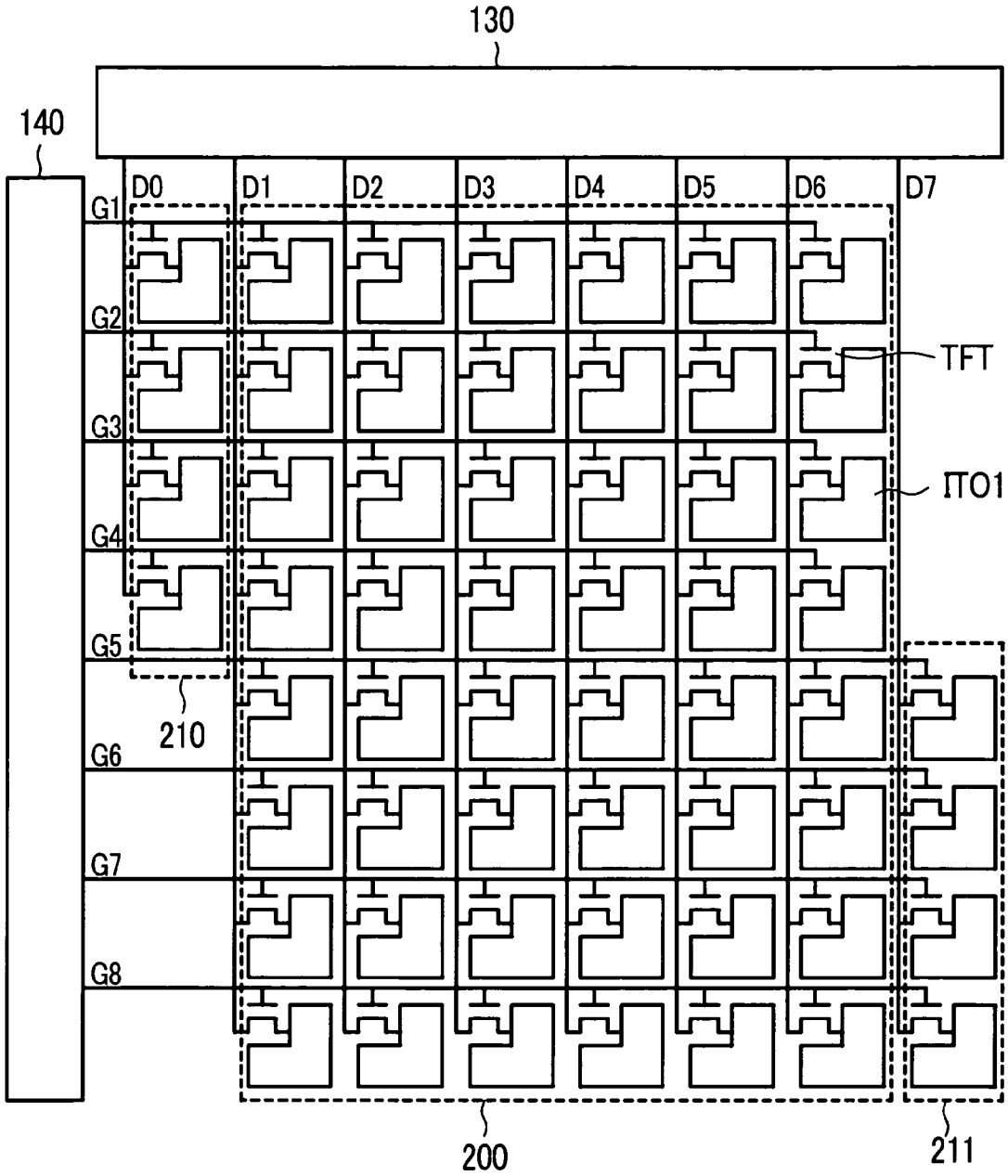
FIG. 4 is a schematic diagram illustrating one example of an arrangement of dummy pixels of the embodiment of the present invention.

FIG. 4 is a schematic diagram showing one example of the arrangement of the dummy pixels of this embodiment. In FIG. 4, the pixels 200 in a matrix array of 8×6 pixels are arranged inside of the effective display regions and four dummy pixels 210 and four dummy pixels 211 are arranged outside the effective display region. Further, in FIG. 4, numeral 130 indicates a drain driver, numeral 140 indicates a gate driver and symbol ITO1 indicates the pixel electrodes.

In the example shown in FIG. 4, the gate electrodes of the respective thin film transistors (TFT) of the dummy pixels (210, 211) are connected to the gate signal lines (G1 to G8) which supply a scanning signal voltage to respective pixels 200 inside of the effective display region.

However, the drain electrodes of the respective thin film transistors (TFT) of the dummy pixels (210, 211) are connected to dedicated drain signal lines (D0, F7) and a gray scale voltage having either positive polarity or negative polarity and also having an arbitrary gray scale between the gray scale voltage of maximum gray scale and the gray scale voltage of minimum gray scale is applied to these dedicated drain signal lines (D0, F7) from the drain driver 130.

Here, the explanation presented hereinafter will be directed to a case in which the gray scale voltage having either a positive polarity or a negative polarity and also having the maximum gray scale (hereinafter simply referred to as the maximum gray scale voltage) is applied to these dedicated drain signal lines (D0, F7) from the drain driver 130. However, the gray scale voltage which is applied to these dedicated drain signal lines (D0, F7) from the drain driver 130 may be the gray scale voltage having either a positive polarity or a negative polarity and also having the minimum gray scale.

Figure 5:
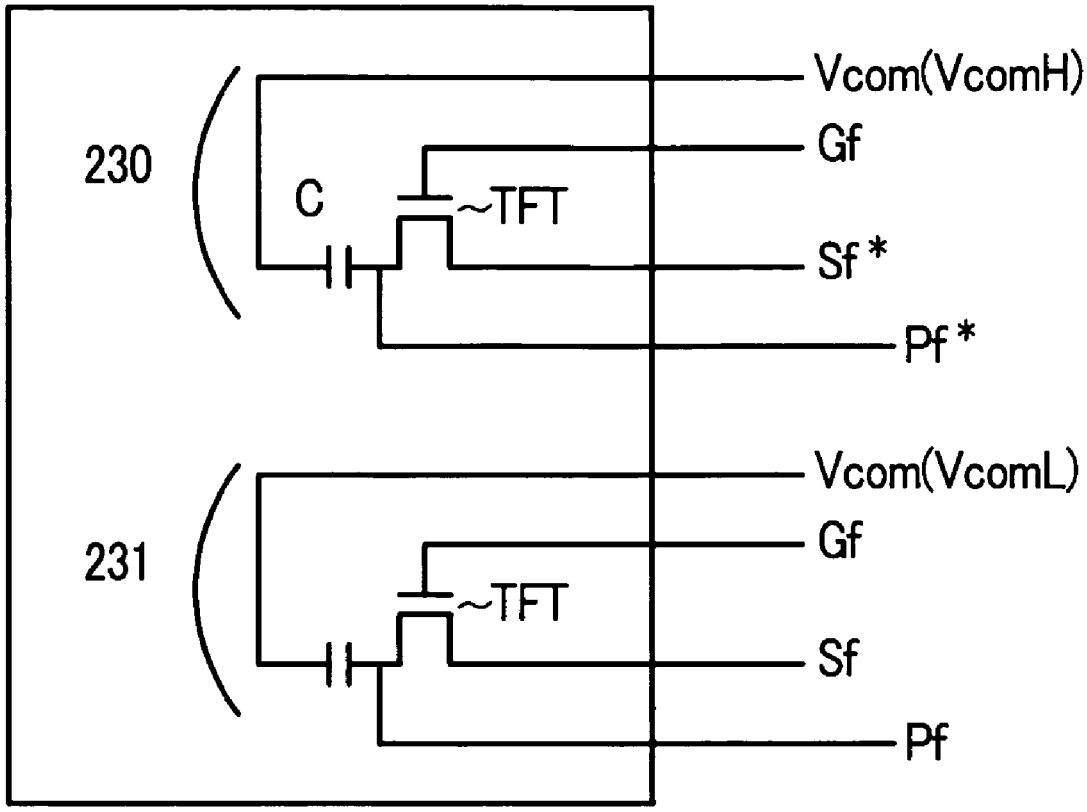
FIG. 5 is a schematic circuit diagram illustrating the polarities of a video signal voltage written in the dummy pixels of the embodiment of the present invention.

FIG. 5 is a diagram showing the polarities of the video signal voltage which is written in the dummy pixels of this embodiment. In FIG. 5, a first group of dummy pixels 230 and a second group of dummy pixels 231 indicate groups of pixels in which the gray scale voltages of maximum gray scales having different polarities from each other are written within one frame.

For example, when the previously-mentioned method shown in FIG. 2 is adopted as the AC driving method of this embodiment, in the liquid crystal display panel shown in FIG. 4, the first group of dummy pixels 230 correspond to a group of dummy pixels in which the gate electrodes of the thin film transistors are connected to the gate signal lines G1, G3, G5 and G7 and the second group of dummy pixels 231 correspond to a group of dummy pixels in which the gate electrodes of the thin film transistors are connected to the gate signal lines G2, G4, G6 and G8.

Here, FIG. 5 shows a case in which the maximum gray scale voltage of negative polarity is written in the first group of dummy pixels 230 and the maximum gray scale voltage of positive polarity is written in the second group of dummy pixels 231.

In FIG. 5, when the gray scale voltage of positive polarity is written in the respective pixels inside of the effective display region 200, the scanning signal voltage (Gf) which is applied to the gate electrodes of the thin film transistors (TFT) of the second group of dummy pixels 231 assumes the High level, and, hence, the thin film transistors (TFT) of the second group of dummy pixels 231 are turned on, and the maximum gray scale voltage (Sf) of positive polarity is applied to the pixel electrodes. In this case, the common voltage (Vcom) applied to the common electrodes is the common voltage (VcomL) of negative polarity.

Thereafter, when the thin film transistors (TFT) are turned off, as mentioned previously, the voltage of the pixel electrodes of the dummy pixels is changed by ΔV, and, hence, the voltage of the pixel electrodes of the dummy pixels assumes (Pf).

In the same manner, when the gray scale voltage of negative polarity is written in the respective pixels in the inside of the effective display region 200, the scanning signal voltage (Gf), which is applied to the gate electrodes of the thin film transistors (TFT) of the first group of dummy pixels 230, assumes the High level, and, hence, the thin film transistors (TFT) of the first group of dummy pixels 230 are turned on and the maximum gray scale voltage (Sf*) of negative polarity is applied to the pixel electrodes. In this case, the common voltage (Vcom) applied to the common electrodes is the common voltage (VcomH) of positive polarity.

Thereafter, when the thin film transistors (TFT) are turned off, as mentioned previously, the voltage of the pixel electrodes of the dummy pixels is changed by ΔV, and, hence, the voltage of the pixel electrodes of the dummy pixels assumes (Pf*).

Here, in FIG. 5, the liquid crystal capacitance ($C_{LC}$) and the storage capacitance ($C_S$) shown in FIG. 11 are expressed by the single capacitance element (C).

As shown in FIG. 5, in this embodiment, the voltages (Pf) and (Pf*) are taken out in the liquid crystal display panel and the common voltage applied to the common electrodes is adjusted based on these voltages.

Figure 6:
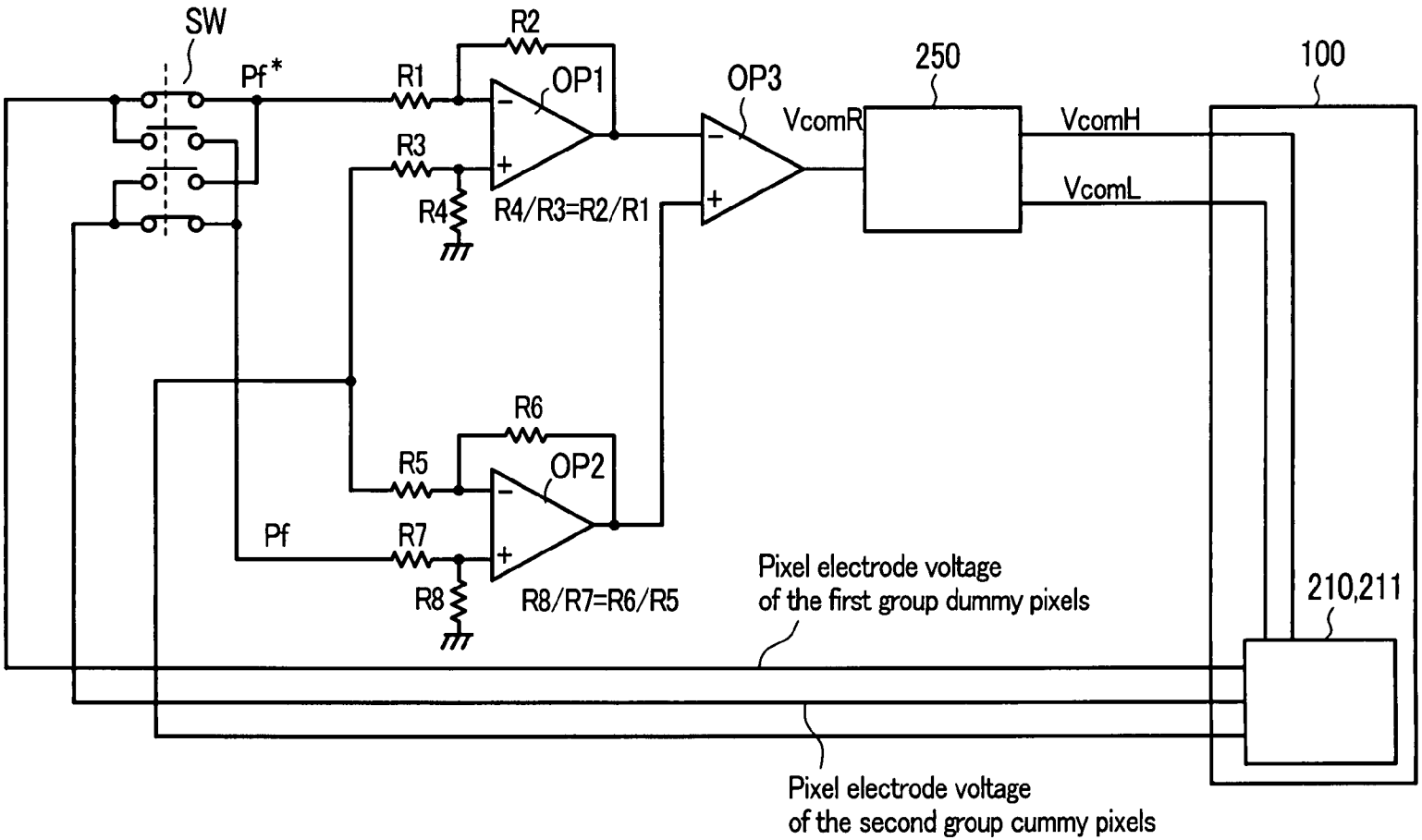
FIG. 6 is a schematic diagram showing one example of a circuit for adjusting a common voltage applied to common electrodes in the embodiment of the present invention.

FIG. 6 is a view showing one example of a circuit for adjusting the common voltage applied to the common electrodes in this embodiment.

For example, the voltage (Pf*) of the pixel electrodes of the first group of pixels shown in FIG. 5 is inputted to an inverted terminal (−) of an operational amplifier (OP1) shown in FIG. 6, while the voltage (Pf) of the pixel electrodes of the second group of pixels shown in FIG. 5 is inputted to an non-inverted terminal (+) of an operational amplifier (OP2) shown in FIG. 6. Further, the common potential (Vcom) of the common electrodes is inputted to a non-inverted terminal (+) of the operational amplifier (OP1) and an inverted terminal (−) of the operational amplifier (OP2).

In the circuit shown in FIG. 6, when a relationship R4/R3=R2/R1 and a relationship R8/R7=R6/R5 are established, a voltage (Vcom−Pf*) is outputted from the operational amplifier (OP1) and a voltage (Pf−Vcom) is outputted from the operational amplifier (OP2). These voltages are inputted to an operational amplifier (OP3), and a voltage VcomR is outputted from the operational amplifier (OP3) such that a relationship (Vcom−Pf*)=(Pf−Vcom) is established.

A common voltage generating circuit 250 generates the common voltage (VcomH) of positive polarity and the common voltage (VcomL) of negative polarity based on the inputted voltage VcomR.

To be more specific, the common voltage generating circuit 250 fixes the potential difference V1 (=VcomH−VcomL) between the common voltage of positive polarity (VcomH) and the common voltage (VcomL) of negative polarity and sets the common voltage (VcomH) of positive polarity as the voltage VcomR. Accordingly, in the circuit shown in FIG. 6, the common voltage (VcomH) of positive polarity and the common voltage (VcomL) of negative polarity are adjusted such that the relationship (Vcom−Pf*=Pf−Vcom) is established.

In this manner, in the liquid crystal display panel of this embodiment, in both cases of positive polarity and negative polarity, the voltages which are symmetrical with respect to the voltage (Vcom) of the common electrodes (ITO2) are applied to the liquid crystal, and, hence, the occurrence of flickers on the screen can be prevented.

Here, when the previously-mentioned method shown in FIG. 2 is adopted as the AC driving method, the voltage (Vcom) of the common electrodes is changed from the common voltage (VcomH) of positive polarity to the common voltage (VcomL) of negative polarity or from the common voltage (VcomL) of negative polarity to the common voltage (VcomH) of positive polarity. Accordingly, in the circuit shown in FIG. 6, although the voltage (Vcom) of the common electrodes, which is inputted to the operational amplifier (OP1, OP2), is changed, after the gray scale voltage (the gray scale voltage of either positive polarity or negative polarity) is written in the dummy pixels, the thin film transistors (TFT) are turned off and the pixel electrodes of the dummy pixels assume a floating state. Accordingly, the voltage of the pixel electrodes of the dummy pixels is also changed in response to the voltage (Vcom) of the common electrodes, and, hence, the voltage between the pixel electrodes of the dummy pixels and the common electrodes assumes a substantially fixed value.

Further, as explained previously in conjunction with FIG. 2, the polarity of the gray scale voltage, which is written in the first group of the dummy pixels 230 or the second group of the dummy pixels 231, is inverted every one frame.

Accordingly, the circuit shown in FIG. 6 is provided with a switch (SW) and an ON/OFF operation of the switch (SW) is controlled in response to an AC signal (M) such that the voltage of the pixel electrodes of the dummy pixels, in which the maximum gray scale voltage of negative polarity is written, is applied to the inverted terminal (−) of the operational amplifier (OP1), and the voltage of the pixel electrodes of the dummy pixels, in which the maximum gray scale voltage of positive polarity is written, is applied to the non-inverted terminal (+) of the operational amplifier (OP2).

Figure 7:
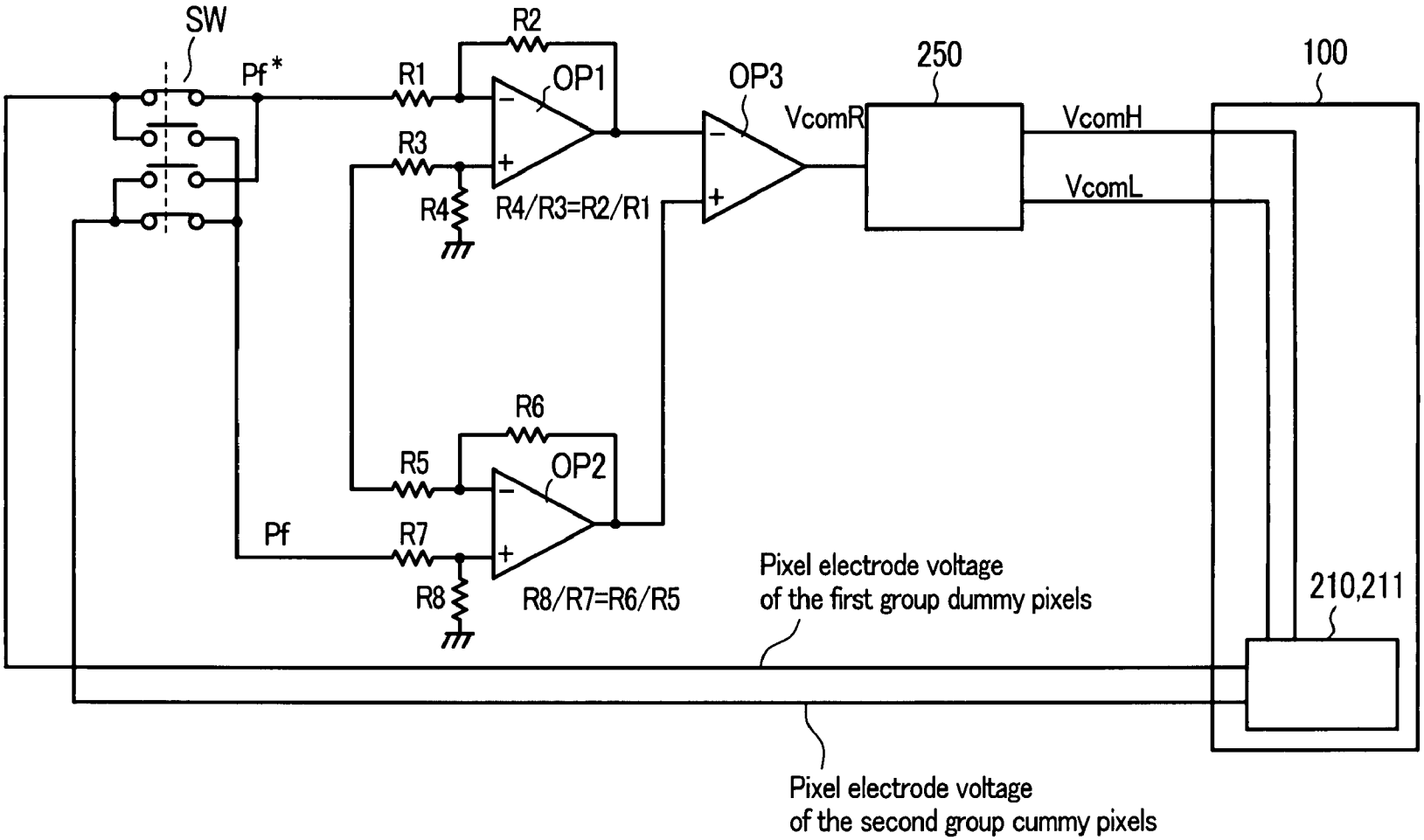
FIG. 7 is a schematic diagram showing another example of the circuit for adjusting the common voltage applied to the common electrodes in the embodiment of the present invention.

FIG. 7 shows another example of the circuit for adjusting the common voltage applied to the common electrodes in this embodiment.

The circuit shown in FIG. 7 differs from the circuit shown in FIG. 6 with respect to the fact that the common voltage (VcomH) of positive polarity outputted from the common voltage generating circuit 250 is applied to the non-inverted terminal (+) of the operational amplifier (OP1) and the common voltage (VcomL) of negative polarity outputted from the common voltage generating circuit 250 is applied to the inverted terminal (−) of the operational amplifier (OP2).

Since the manner of operation of the circuit shown in FIG. 7 is equal to the manner of operation of the circuit shown in FIG. 6, a repeated explanation thereof will be omitted.

However, as mentioned previously, when the method shown in FIG. 2 is adopted as the AC driving method, the voltage (Vcom) of the common electrodes is changed. Accordingly, in the circuit shown in FIG. 7, it is necessary to control the switch (SW) such that the voltage of the pixel electrodes of the dummy pixels is applied to the inverted terminal (−) of the operational amplifier (OP1) only when the gray scale voltage of positive polarity is written in the respective pixels inside of the effective display region 200 or the voltage of the pixel electrodes of the dummy pixels is applied to the non-inverted terminal (+) of the operational amplifier (OP2) only when the gray scale voltage of negative polarity is written in the respective pixels inside of the effective display region 200.

[Other Constitution of the Liquid Crystal Display Module which Constitutes the Premise of the Present Invention]

Figure 8A:
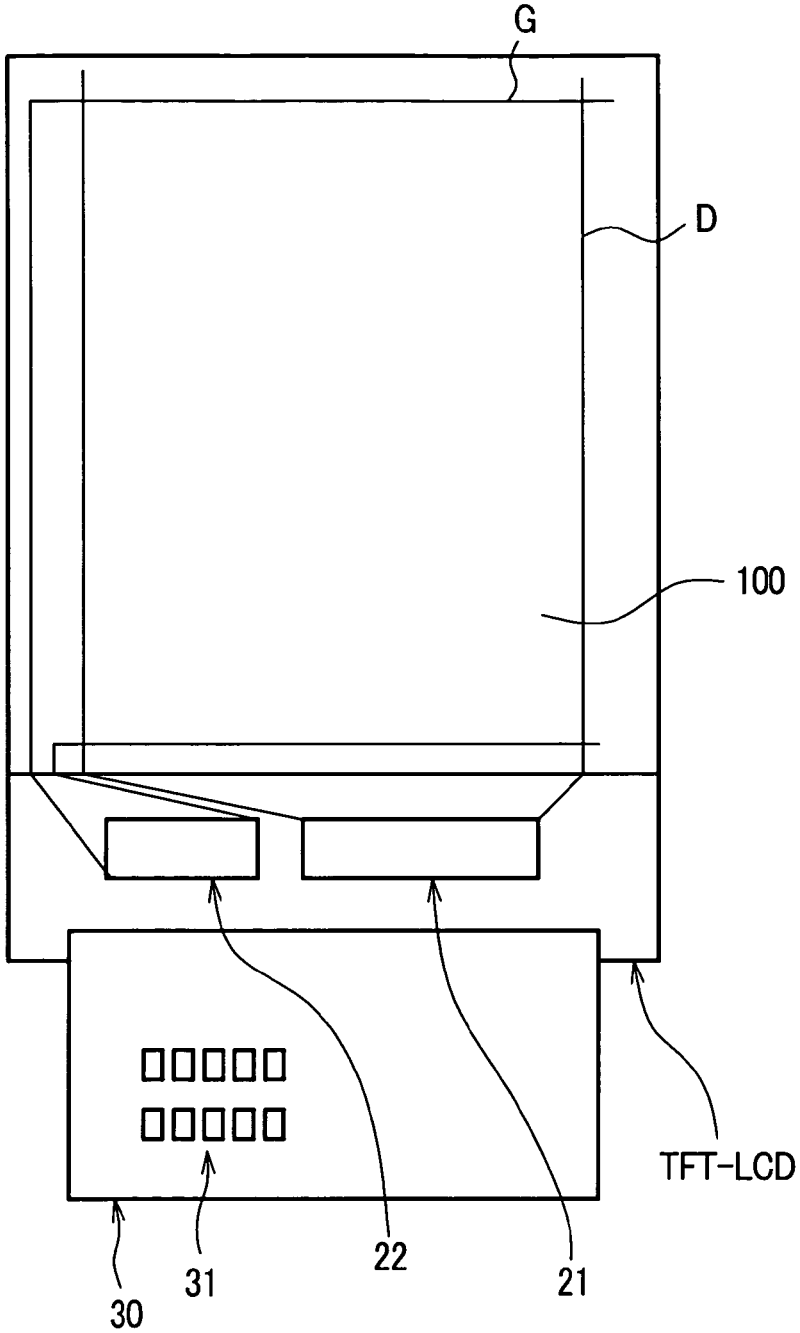
FIG. 8A is a diagrammatic plan view and FIG. 8B is a diagrammatic side view showing the constitution of another example of the image display module (the liquid crystal display module) which constitutes the premise of the present invention.
Figure 8B:
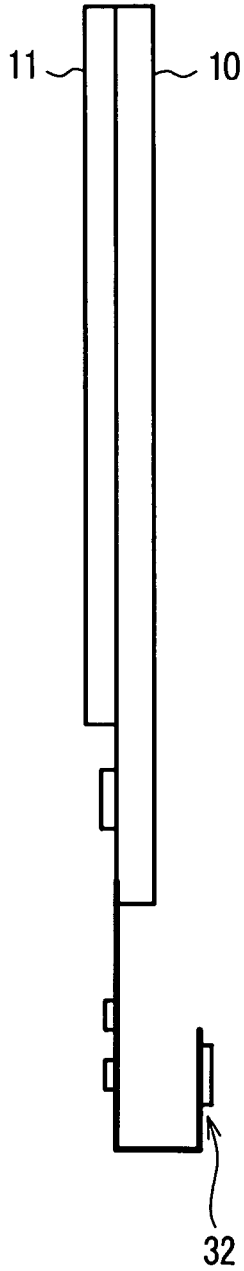

FIG. 8A is a plan view and FIG. 8B is a side view showing the constitution of another example of the liquid crystal display module which constitutes the premise of the present invention.

The liquid crystal display module shown in FIG. 8A differs from the liquid crystal display module shown in FIG. 1A with respect to the fact that two liquid crystal drivers consisting of a liquid crystal driver 21 and a liquid crystal driver 22 are used in place of the single liquid crystal driver 20 shown in FIG. 1A.

The other constitutions of the liquid crystal display module shown in FIGS. 8A and 8B are equal to those of the liquid crystal display module shown in FIGS. 1A and 1B, and, hence, a repeated explanation thereof will be omitted.

Here, the liquid crystal driver 21 incorporates the function of the drain driver 130 shown in FIG. 10 and the liquid crystal driver 22 incorporates the function of the gate driver 140 shown in FIG. 10. Further, although the display control device 110 and the power source circuit 120 shown in FIG. 10 may be incorporated into at least either one of the liquid crystal driver 21 and the liquid crystal driver 22, in the liquid crystal display module shown in FIG. 8A, the display control device 110 shown in FIG. 10 is incorporated in the liquid crystal driver 21 and the power source circuit 120 shown in FIG. 10 is incorporated in the liquid crystal driver 22.

Here, the previous explanation have been directed to embodiments in which the present invention is applied to a liquid crystal display module which adopts the common electrode inversion method as the AC driving method. However, the present invention is not limited to these embodiments and is applicable to liquid crystal display modules which adopt the common electrode symmetry method as the AC driving method.

Figure 9:
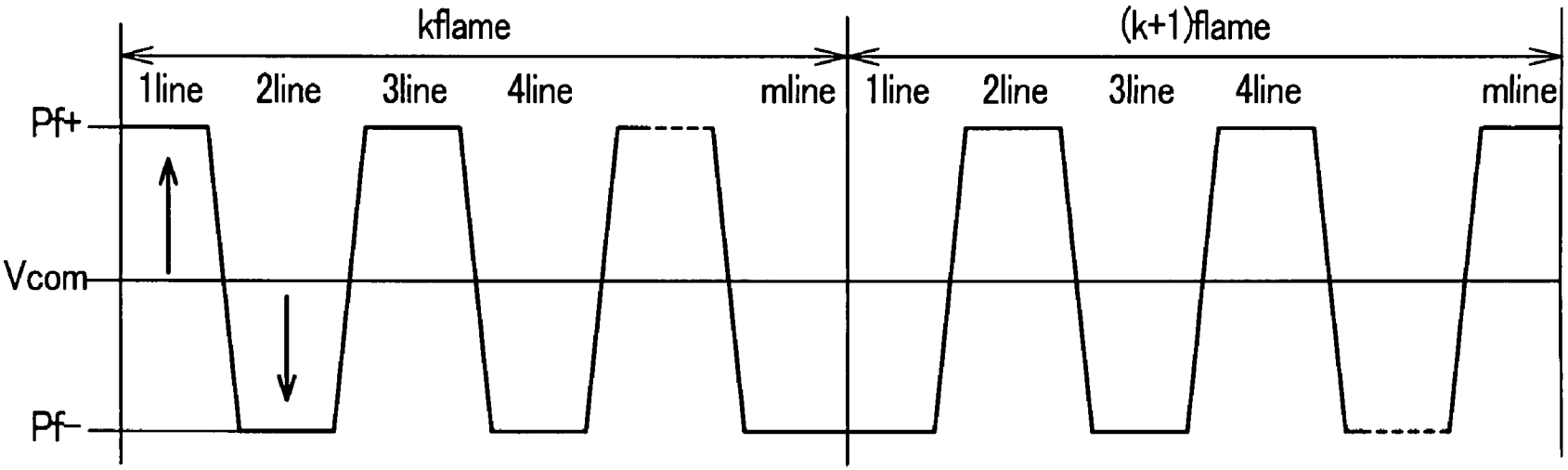
FIG. 9 is a timing diagram illustrating a common electrode symmetry scheme in the AC driving method of the image display module (the liquid crystal display module)

FIG. 9 is a timing diagram illustrating the common electrode symmetry method in the AC driving method of the liquid crystal display module. Here, in FIG. 9, the explanation is directed to a case in which the polarity is inverted every one horizontal scanning line (hereinafter simply referred to as every line).

As shown in FIG. 9, in the common electrode symmetry method, in an odd-numbered line (for example, lines 1, 3, 5 or the like) in a k-frame, a gray scale voltage of positive polarity is applied to pixel electrodes (ITO1) of the respective pixels (that is, the respective drain signal lines D), while in an even-numbered line (for example, lines 2, 4, 6 or the like) in the k-frame, a gray scale voltage of negative polarity is applied to pixel electrodes (ITO1) of the respective pixels.

Then, in an odd-numbered line (for example, lines 1, 3, 5 or the like) in a (k+1)-frame which succeeds the k-frame, a gray scale voltage of negative polarity is applied to pixel electrodes (ITO1) of the respective pixels, while in an even-numbered line (for example, lines 2, 4, 6 or the like) in the (k+1)-frame, a gray scale voltage of positive polarity is applied to pixel electrodes (ITO1) of the respective pixels.

However, in the common electrode symmetry method, the common voltage (Vcom) applied to the common electrodes (ITO2) is set to a fixed value.

Here, in FIG. 9, arrows indicate polarities of the voltage applied to the liquid crystal. As shown in FIG. 9, the common electrode symmetry method has a drawback in that the amplitude of the voltage applied to the pixel electrodes (ITO1) is twice as large as the amplitude of the pixel electrodes (ITO1) in the common electrode inversion method, and, hence, a low dielectric strength driver cannot be used. However, a dot inversion method or an N line inversion method, which has an excellent display quality and a low power consumption, can be used.

When the present invention is applied to a liquid crystal display module which adopts the common electrode symmetry method as the AC driving method, either one of the common voltage (VcomH) of positive polarity and the common voltage (VcomL) of negative polarity, which are outputted from the common voltage generating circuit 25 shown in FIG. 6 and FIG. 7, may be used as the common voltage (Vcom), and either one of the common voltage (VcomH) of positive polarity and the common voltage (VcomL) of negative polarity, which are outputted from the voltage generating circuit 250, may be adjusted such that the potential difference between the voltage and the voltage of the pixel electrodes of the dummy pixels in which the maximum gray scale voltage of positive polarity is written and the potential difference between the voltage and the voltage of the pixel electrodes of the dummy pixels in which the maximum gray scale voltage of negative polarity is written agree with each other.

As described above, according to these embodiments, it is possible to prevent the occurrence of flickers on the display screen by automatically adjusting the common voltage applied to the common electrodes without the need for light receiving elements.

Further, since the common voltage applied to the common electrodes is adjusted, additional parts, such as variable resistors or the like, are not necessary, whereby the number of parts can be reduced, thus leading to a miniaturization of the profile size of the product (for example, a mobile phone).

Further, since the common voltage applied to the common electrodes is adjusted based on the voltage of the pixel electrodes of the dummy pixels, even when the voltage of the pixel electrodes of the dummy pixels is changed due to an external factor, such as the temperature or outdoor light, it is possible to automatically adjust the common voltage applied to the common electrodes in accordance with the change of the voltage of the pixel electrodes of the dummy pixels, whereby it is possible to prevent the generation of flickers on the display screen attributed to the external factor. Accordingly, the usable temperature range of the product can be broadened.

Although the present invention has made by inventors have been specifically explained based on the above-mentioned embodiments, it is needless to say that the present invention is not limited to the above-mentioned embodiments, and various modifications can be made without departing from the gist of the invention.

To briefly recapitulate, the advantageous effects obtained by the representative aspects and features of the invention disclosed in this specification are as follows.

According to the image display devices of the present invention, it is possible to prevent the occurrence of flickers on the display screen by automatically adjusting the common voltage applied to the common electrodes without any need for provision of light receiving elements.

The invention claimed is:

1. An image display device comprising:

an image display part for displaying an image; and a plurality of dummy pixels which are arranged in a periphery of the image display part, wherein the plurality of dummy pixels are pixels to which a voltage is applied based on pixel electrodes and common electrodes corresponding to the dummy pixels, a first potential difference between a voltage of pixel electrodes of the dummy pixels to which a given gray scale voltage of positive polarity is written among the plurality of dummy pixels and a common voltage applied to the common electrodes corresponding to the dummy pixels is detected, a second potential difference between a voltage of pixel electrodes of the dummy pixels to which a given gray scale voltage of negative polarity is written among the plurality of dummy pixels and the common voltage applied to the common electrodes corresponding to the dummy pixels is detected, and the voltage applied to the common electrodes is controlled so as to make the first potential difference and the second potential difference equal to each other.

2. An image display device according to claim 1, wherein the image display device adopts a common electrode inversion method as an AC driving method and the common voltage of negative polarity when the given gray scale voltage of positive polarity is written in the plurality of dummy pixels and the common voltage of positive polarity when the given gray scale voltage of negative polarity is written in the plurality of dummy pixels are controlled so as to make the first potential difference and the second potential difference equal to each other.

3. An image display device according to claim 1, wherein the image display device adopts a common electrode symmetry method as an AC driving method and the common voltage when the given gray scale voltage of positive polarity or negative polarity is written in the plurality of dummy pixels is controlled so as to make the first potential difference and the second potential difference equal to each other.

4. An image display device according to claim 1, wherein the given gray scale voltage is a gray scale voltage of maximum gray scale.

5. An image display device according to claim 1, wherein the given gray scale voltage is a gray scale voltage of minimum gray scale.

6. An image display device according to claim 1, wherein the given gray scale voltage is an arbitrary gray scale voltage between a gray scale voltage of maximum gray scale and a gray scale voltage of minimum gray scale.

7. An image display device comprising:

an image display part for displaying an image; and a plurality of dummy pixels which are arranged in a periphery of the image display part, wherein the plurality of dummy pixels include pixel electrodes, and the image display device further includes a first means which detects a potential difference between a voltage of the pixel electrodes of the dummy pixels to which a given gray scale voltage of positive polarity is written among the plurality of dummy pixels and a common voltage applied to common electrodes, a second means which detects a potential difference between a voltage of the pixel electrodes of the dummy pixels to which a given gray scale voltage of negative polarity is written among the plurality of dummy pixels and the common voltage applied to the common electrodes, and a control means which controls the voltage applied to the common electrodes so as to make the first potential difference detected by the first means and the second potential difference detected by the second means equal to each other.

8. An image display device according to claim 7, wherein the image display device adopts a common electrode inversion method as an AC driving method and the control means controls the common voltage of negative polarity when the given gray scale voltage of positive polarity is written in the plurality of dummy pixels and the common voltage of positive polarity when the given gray scale voltage of negative polarity is written in the plurality of dummy pixels so as to make the potential difference detected by the first means and the potential difference detected by the second means equal to each other.

9. An image display device according to claim 7, wherein the image display device adopts a common electrode symmetry method as an AC driving method, and the control means controls the common voltage when the given gray scale voltage of positive polarity or negative polarity is written in the plurality of dummy pixels so as to make the potential difference detected by the first means and the potential difference detected by the second means equal to each other.

10. An image display device according to claim 7, wherein the given gray scale voltage is a gray scale voltage of maximum gray scale.

11. An image display device according to claim 7, wherein the given gray scale voltage is a gray scale voltage of minimum gray scale.

12. An image display device according to claim 7, wherein the given gray scale voltage is an arbitrary gray scale voltage between a gray scale voltage of maximum gray scale and a gray scale voltage of minimum gray scale.

13. An image display device comprising:

an image display part; and a plurality of dummy pixels, wherein the plurality of dummy pixels are pixels to which a voltage is applied based on pixel electrodes and common electrodes corresponding to the dummy pixels, and a voltage applied to the common voltage is controlled so as to make a potential difference between a voltage of pixel electrodes of the dummy pixels to which a given gray scale voltage of positive polarity is written among the plurality of dummy pixels and a common voltage applied to the common electrodes and a potential difference between a voltage of pixel electrodes of the dummy pixels to which a given gray scale voltage of negative polarity is written among the plurality of dummy pixels and the common voltage applied to the common electrodes equal to each other.

* * * * *